US009199787B2

(12) United States Patent
Roger

(10) Patent No.: US 9,199,787 B2
(45) Date of Patent: Dec. 1, 2015

(54) CONTAINER FOR TRANSPORTING AND/OR STORING RADIOACTIVE MATERIALS

(75) Inventor: Christophe Roger, Noisy le Grand (FR)

(73) Assignee: TN INTERNATIONAL, Montigny le Bretonneux (FR)

( * ) Notice: Subject to any disclaimer, the term of this patent is extended or adjusted under 35 U.S.C. 154(b) by 192 days.

(21) Appl. No.: 13/806,103

(22) PCT Filed: Jun. 24, 2011

(86) PCT No.: PCT/EP2011/060610

§ 371 (c)(1),
(2), (4) Date: Dec. 20, 2012

(87) PCT Pub. No.: WO2011/161233

PCT Pub. Date: Dec. 29, 2011

(65) Prior Publication Data

US 2013/0092684 A1 Apr. 18, 2013

(30) Foreign Application Priority Data

Jun. 25, 2010 (FR) ..... 10 55109

(51) Int. Cl.
*B65D 6/26* (2006.01)
*B65D 85/00* (2006.01)
(Continued)

(52) U.S. Cl.
CPC ..... *B65D 85/70* (2013.01); *B65D 25/00* (2013.01); *G21F 5/012* (2013.01); *G21F 5/10* (2013.01)

(58) Field of Classification Search
CPC ..... B65D 6/26; B65D 25/00; B65D 81/325
USPC ..... 220/4.01, 4.04, 4.08, 507, 531, 529, 220/4.09; 376/272
See application file for complete search history.

(56) References Cited

U.S. PATENT DOCUMENTS 4,666,659 A 5/1987 Lusk et al.
5,156,289 A * 10/1992 Goof ..... 220/23.2
(Continued)

FOREIGN PATENT DOCUMENTS

FR 2 915 307 10/2008
JP 2002-98797 A 4/2002
(Continued)

OTHER PUBLICATIONS

International Search Report and Written Opinion for International Application No. PCT/EP2011/060610, mailed Oct. 10, 2011.
(Continued)

*Primary Examiner* — Anthony Stashick
*Assistant Examiner* — Raven Collins
(74) *Attorney, Agent, or Firm* — Nixon Peabody LLP

(57) ABSTRACT

A removable storage device intended to be housed in a cavity of a form of packaging for transporting and/or storing radioactive materials, including several substructures movable relative to one another, positioned around a longitudinal axis, and defining multiple adjacent recesses for radioactive materials, together with means for deployment of the substructures including actuation means acting by shape collaboration on the substructures through a bearing surface having, in a section according to any plane passing through longitudinal axis, the shape of a segment inclined relative to this axis, such that displacement of actuation means in a first direction parallel to longitudinal axis causes a displacement of the substructures radially towards the exterior relative to longitudinal axis.

9 Claims, 4 Drawing Sheets

(51) Int. Cl.

| | |
|---|---|
| ***G21F 5/012*** | (2006.01) |
| ***G21F 5/10*** | (2006.01) |
| ***B65D 25/00*** | (2006.01) |

(56) References Cited

U.S. PATENT DOCUMENTS

| | | | | |
|---|---|---|---|---|
| D463,120 | S * | 9/2002 | Yoshinaka | D3/299 |
| 2010/0119029 | A1 | 5/2010 | Viallon et al. | |
| 2014/0105347 | A1 * | 4/2014 | Singh et al. | 376/272 |

FOREIGN PATENT DOCUMENTS

| | | |
|---|---|---|
| WO | 2006/019307 | 2/2006 |
| WO | 2008/135359 | 11/2008 |

OTHER PUBLICATIONS

French Preliminary Search Report for French Application No. 1055109, dated Nov. 4, 2010.

* cited by examiner

FIG. 2
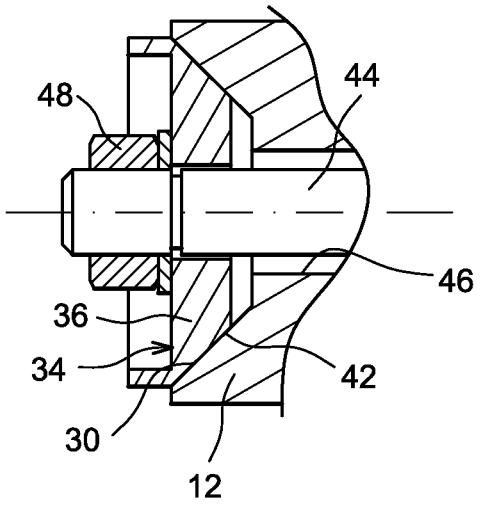
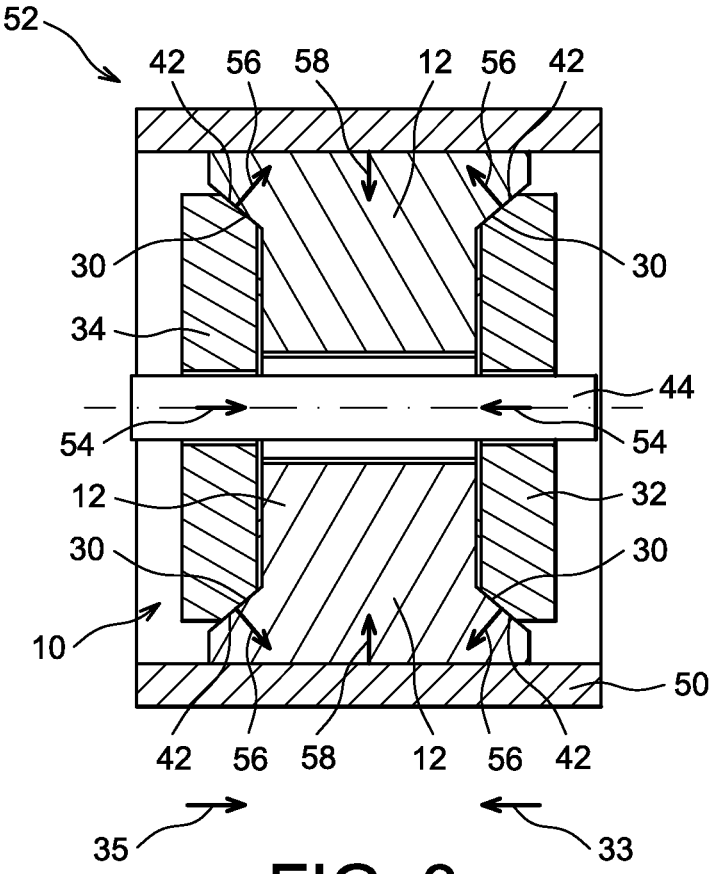
FIG. 3

CONTAINER FOR TRANSPORTING AND/OR STORING RADIOACTIVE MATERIALS

CROSS REFERENCE TO RELATED APPLICATIONS OR PRIORITY CLAIM

This application is a National Phase of PCT/EP2011/060610, filed Jun. 24, 2011, entitled, "CONTAINER FOR TRANSPORTING AND/OR STORING RADIOACTIVE MATERIALS", which claims the benefit of French Patent Application No. 10 55109, filed Jun. 25, 2010, the contents of which are incorporated herein by reference in their entirety.

TECHNICAL FIELD

The present invention relates generally to the field of the transport and/or storage of radioactive materials, such as assemblies of irradiated nuclear fuel.

However, the invention could also apply to the field of transport and/or storage of assemblies of fresh nuclear fuel, for example of the MOX type, without going beyond the scope of the invention.

It could also find an application in the field of the transport and/or storage of other types of radioactive materials, namely and more specifically radioactive materials releasing substantial thermal power, such as vitrified waste, also called "glasses", which are fission products.

STATE OF THE PRIOR ART

During the transport and/or storage of nuclear fuel assemblies, the latter are habitually housed in storage devices, also called storage "baskets" or "racks". Such a device is generally cylindrical in shape with a roughly circular section, and has multiple adjacent recesses each one of which is able to receive a nuclear fuel assembly. In addition, a device of this type is intended to be housed in the cavity of a form of packaging in order to form jointly with the latter a container for the transport and/or storage of nuclear fuel assemblies, in which the radioactive material is completely confined.

It should be noted that a storage device is generally removable. In other words, it is designed such that it is possible and easy to store in the cavity of the packaging. An operating clearance is allowed between the cavity of the packaging and the storage device to allow operations to load/unload the storage device. In addition, storage devices of different configurations can be suitable for a given type of packaging, in order to form with the latter containers which are suitable for transport and/or storage of nuclear fuel assemblies of varied types.

It is generally desirable that thermal conduction between the storage device and the packaging should be efficient, to allow the evacuation, to outside the container, of the substantial heat released by the fuel assemblies.

This heat evacuation is sought notably in order to maintain the temperature of the fuel assemblies below a maximum authorised temperature. If this temperature is exceeded the integrity of the fuel pencils which constitute the assemblies could indeed be weakened due to the potential deterioration of the mechanical characteristics of the pencil claddings.

In addition, the mechanical resistance of the storage device must satisfy the statutory safety requirements for transport and storage of radioactive materials, notably regarding the tests known as "free drop" tests. But the mechanical characteristics of the materials used for manufacturing the storage devices can deteriorate, depending on the temperature, in particular when these materials are aluminium or one of its alloys. Heat evacuation between the storage device and the packaging is therefore also sought, in order to ensure that the storage device has satisfactory mechanical resistance.

For economic reasons the lateral internal surface delimiting the cavity of the packaging is manufactured with substantial manufacturing tolerances. One of the disadvantages resulting from the use of substantial manufacturing tolerances lies in the need to increase appreciably the clearance habitually allowed to make it possible and easy to load a detachable storage device into the cavity of the packaging, as mentioned above. The clearance maintained then leads to a thermal insulation effect which runs counter to the overall aim sought of thermal conduction between the storage device and the packaging, thereby making it difficult to evacuate the heat released by the nuclear fuel assemblies.

In order to improve the thermal conduction between a storage device and the packaging intended to receive it, a storage device is proposed in patent application WO 2008/135359 which includes a main structure defining at least one recess intended to contain the radioactive materials, together with a moving thermal conduction structure forming at least a portion of a lateral external surface of the storage device, where this moving structure includes at least one moving thermal conduction element installed on the main structure such that it can be moved from a retracted position to a deployed position as it moves away from the main structure.

However, the moving structure proposed in the abovementioned document is relatively complex and costly. In addition, when it is deployed this structure has thermal bridges the small span of which limits the ability of this structure to conduct heat.

DESCRIPTION OF THE INVENTION

One aim of the invention is notably to provide a simple, economic and efficient solution to these problems, allowing the abovementioned disadvantages to be avoided.

Its object is a storage device allowing satisfactory thermal conduction, whilst being of relatively simple design.

To this end the invention proposes a detachable storage device intended to be housed in an internal cavity of a form of packaging for the transport and/or storage of radioactive materials. The device includes several substructures which can be moved relative to one another, and which are positioned around a longitudinal axis of the device, where all these substructures define multiple adjacent recesses intended to contain the radioactive materials, and each substructure delimits at least partly at least one of said recesses.

According to the invention, the device includes means to deploy these substructures, including actuation means acting by collaboration of shapes on said substructure, through at least one bearing surface having, when seen in section according to any plane passing through the abovementioned longitudinal axis, the shape of a line segment which is inclined relative to said axis, such that a movement of these actuation means in a first direction parallel to the longitudinal axis of the device causes said substructure to be displaced radially towards the exterior relative to the longitudinal axis of the device.

The deployment means enable, during or after insertion of the storage device in the internal cavity of a form of packaging, at least one—and preferably each—of the substructures of the device to be separated from the longitudinal axis of the latter, and thus the clearance between the abovementioned substructure or substructures and the wall of the internal cavity of the packaging to be reduced.

This reduction of clearance enables the heat exchanges between the storage device and the packaging in which the device is housed to be improved, and therefore evacuation of the heat released by any fuel assemblies housed in the device to be optimised.

In addition, the conversion from a longitudinal displacement of the actuation means into a radial displacement of the substructures of the device enables the control of the actuation means to be facilitated substantially, as will become clearer in what follows.

The abovementioned bearing surface can be formed on the actuation means and/or on said substructure.

The deployment means are preferentially configured so as to allow contact between at least a portion of an external lateral surface of said substructure of the device and a side wall of the cavity of the packaging, so as to reduce the abovementioned clearance optimally.

The actuation means advantageously cooperate with the abovementioned longitudinal end of said substructure of the device such that a displacement of the actuation means in a second direction opposite to said first direction causes said substructure to be displaced radially towards the interior.

The actuation means thus enable said substructure to be brought closer to the longitudinal axis of the device by moving it away from the wall of the internal cavity of the packaging, notably so as to facilitate the extraction of the storage device to outside the packaging.

In this case, the deployment means advantageously include elastic means which urge said substructure radially towards the exterior, and the actuation means oppose the radial displacement of said substructure radially towards the exterior.

A displacement of the actuation means in the first abovementioned direction parallel to the longitudinal axis thus allows said substructure to be displaced radially towards the exterior under the pressure of the elastic means, whereas a displacement of the actuation means in the second direction, opposite to the first direction, causes the substructure to be displaced radially towards the interior against the elastic means.

The abovementioned bearing surface preferably has a flat or tapered shape, or the shape of a sector of a truncated cone.

The actuation means and said substructure preferably have two respective bearing surfaces of conjugate shapes, facing one another, so as to optimise shape collaboration between the actuation means and said substructure, and notably to facilitate the relative displacement between these actuation means and this substructure.

In a preferred embodiment of the invention, in which the actuation means and said substructure have two respective bearing surfaces of conjugate shapes, the bearing surface of the actuation means is tapered in shape, whereas said substructure has at least one bearing surface shaped like a sector of a truncated cone.

As a variant, the actuation means can include several separate bearing surfaces distributed around the longitudinal axis of the device, which are for example flat in shape, or which are shaped like a sector of a truncated cone, each of which is intended to match a corresponding bearing surface of a substructure of the device, of conjugate shape.

The abovementioned bearing surface is generally advantageously formed on or positioned opposite a longitudinal end of said substructure. In other words, when the actuation means have a bearing surface, it is preferably positioned opposite a longitudinal end of said substructure, and when this substructure has a bearing surface the latter is preferably formed on said longitudinal end of the substructure.

The actuation means preferably include a first element for axial retention of the substructures of the device, on which said bearing surface is formed.

The first element for axial retention is advantageously formed from a first end plate which includes perforations for the passage of said radioactive materials, and on the periphery of which said bearing surface is formed.

This first end plate is intended to be positioned opposite a first longitudinal end of the substructures of the storage device.

The shape of the perforations is preferably similar to that of the respective entrance sections of the recesses defined by the substructures, in order to facilitate optimally loading and unloading of the radioactive materials in the storage device.

As a variant, the first element for axial retention can take the shape of a ring, or of any other equivalent structure which is hollow in the centre and the shape of which is suitable for the geometry of the internal cavity of a form of packaging in which the storage device is intended to be inserted.

The actuation means advantageously include a second element for axial retention of the substructures of the device, connected to said first element for axial retention by at least one longitudinal tie, positioned such that the substructures of the device are interposed between said first and second elements for axial retention.

The second element for axial retention is thus positioned opposite a second longitudinal end of the substructures of the device, opposite the abovementioned first end.

The longitudinal ties are an example of a means of connecting the two elements for axial retention of the substructures of the device, in particular enabling these elements to hold the substructures such that they are securely attached to one another during the handling of the storage device outside the packaging. The assembly formed by the two elements for axial retention and the ties thus constitutes a structure for holding the substructures.

The second element for axial retention preferably has a shape similar to that of the first abovementioned element for axial retention.

The second element for axial retention can thus have the shape of a second end plate similar to the first end plate described above, or alternatively of an unperforated plate when this is of interest.

More generally, the actuation means advantageously include a bearing surface formed on the second element for axial retention and, for example, similar to that of the first element for axial retention, to cooperate with the second abovementioned end of said substructure of the device.

The radial displacement of said substructure of the device, caused by the actuation means, can thus be brought about simultaneously at both opposite ends of this substructure. This can enable the clearance between this substructure and the wall of the internal cavity of the packaging to be reduced still further.

As a variant, it is possible for the device to include only a single element for axial retention, designed to be installed on at least one longitudinal tie attached in a base of the internal cavity of a form of packaging. In this case, the element for axial retention does not allow the mutually securely attached substructures to be held during handling of the storage device outside the packaging.

Generally, and preferentially, at least one abovementioned longitudinal tie includes, at one at least of its ends, a control nut able to cause said elements for axial retention to move towards one another in the direction of the abovementioned longitudinal axis or, if applicable, able to cause the single element for axial retention to move towards the base of the packaging.

Screwing or unscrewing such a nut causes an axial displacement of the first element for axial retention relative to the longitudinal ties, and therefore, if applicable, relative to the second element for axial retention or to the base of the packaging, which leads to an axial displacement of the actuation means supported by this element relative to the substructures, such that the nut forms a means of control of the actuation means.

It should be noted that the abovementioned nut is one example of a means of controlling the actuation means among many other types of control means which can be used in the context of the invention.

In addition, each substructure of the device is advantageously traversed by a matching longitudinal tie of the abovementioned type, guided within said substructure.

The longitudinal ties thus also allow the substructures to be held in the radial direction, when the storage device is handled outside the packaging.

Generally, other configurations of actuation means are possible without going beyond the scope of the invention.

The invention also concerns a container for transporting and/or storing radioactive materials, including a form of packaging delimiting an internal cavity, together with a storage device of the type described above housed in said internal cavity.

BRIEF DESCRIPTION OF THE ILLUSTRATIONS

The invention will be better understood, and other details, advantages and characteristics of it will appear, on reading the following description given as a non-restrictive example, and with reference to the appended illustrations, in which:

FIG. 2 is a partial diagrammatic view as an axial section of the storage device of FIG. 1;

FIG. 3 is a functional diagram of the storage device of FIG. 1;

In all these figures, identical references designate identical or comparable elements.

DETAILED DESCRIPTION OF PREFERRED EMBODIMENTS

Figure 1:
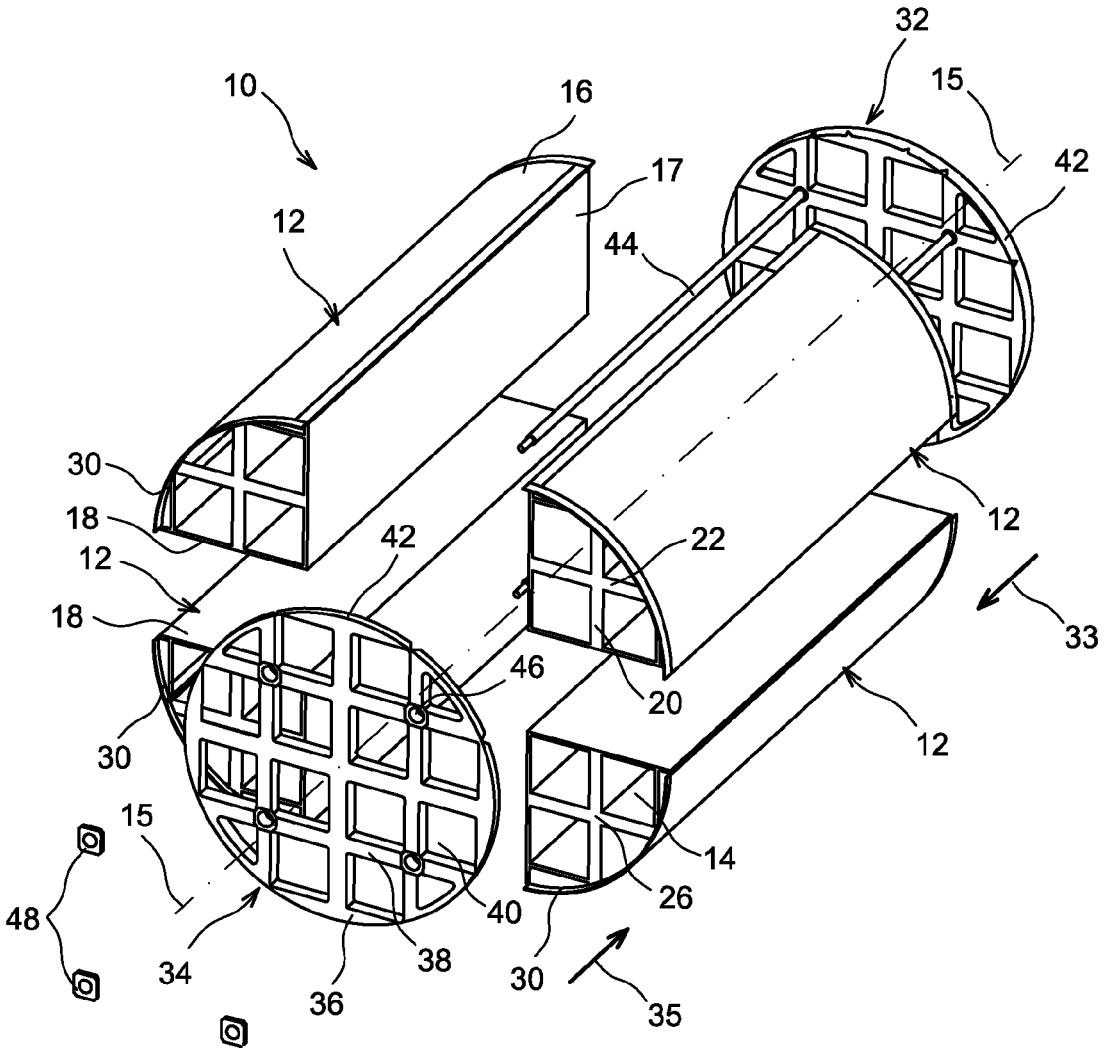
FIG. 1 is a schematic exploded perspective view of a storage device according to a first embodiment of the invention.

FIG. 1 represents a storage device or basket 10 for transporting and/or storing nuclear fuel assemblies in accordance with a first preferred embodiment of the invention.

Storage device 10 is designed to be placed in a form of packaging, not represented in this figure, intended for transporting and/or storing nuclear fuel assemblies, which are also not represented.

Storage device 10 includes four substructures 12, each having the shape of a quarter of right circular cylinder, and including multiple adjacent longitudinal recesses 14, for example three such recesses, each of which extends parallel to a longitudinal axis 15 of device 10, and each of which is able to receive at least one, and preferably a single, fuel assembly of square or rectangular section. Each of these recesses 14 is delimited by an internal surface, the transverse section of which is preferably square or rectangular in shape, such that the abovementioned recess generally has the shape of a rectangular parallelepipede.

In what follows, the term "longitudinal" must be understood as being parallel to longitudinal axis 15 of the storage device, and the term "transverse" must be understood as being orthogonal to this same longitudinal axis 15. In addition, substructures 12 are called quarter baskets in the remainder of this description.

As is shown in FIG. 1, each quarter basket 12 is delimited by an outer wall 16 having the shape of a quarter cylinder, by a first rectangular outer wall 17 having a radially external end connected to a first circumferential end of the outer wall having the shape of a quarter cylinder 16, and by a second rectangular outer wall 18 extending perpendicularly to first rectangular outer wall 17, and having a radially external end connected to a second circumferential end of the outer wall having the shape of a quarter cylinder 16 opposite the first abovementioned circumferential end, together with a radially internal end connected to a radially internal end of first rectangular outer wall 17.

The internal space of each quarter basket 12 is shared by partition walls 20, 22 delimiting the three longitudinal recesses 14 in the quarter basket.

The abovementioned partition walls include a first rectangular wall 20 parallel to the first rectangular outer wall 17, and connected by its lateral ends to the outer wall having the shape of a quarter cylinder 16, and to a median portion of second rectangular outer wall 18.

The partition walls also include a second rectangular wall 22 parallel to second rectangular outer wall 18, and connected by its lateral ends to the outer wall having the shape of a quarter cylinder 16, and to a median portion of first rectangular outer wall 17.

Each quarter basket 12 includes a cylindrical longitudinal recess 26, intended to guide a longitudinal tie, as will appear more clearly in what follows.

At both longitudinal ends of the outer wall having the shape of a quarter cylinder 16 of each quarter basket 12 is a bevelled edge forming a bearing surface 30 having the shape of a section of a truncated cone oriented radially towards the interior.

Storage device 10 also includes two perforated end plates 32 and 34, each of which has a peripheral ring 36 and an internal grid 38 delimiting apertures 40 of section roughly equal to the transverse section of the longitudinal recesses 14 of quarter baskets 12.

Peripheral ring 36 of each end plate 32, 34 has a bevelled outer edge forming a tapered bearing surface 42 oriented radially towards the exterior, and intended to come to rest on bearing surface 30 of each quarter basket 12, as will appear more clearly in what follows.

Storage device 10 also includes four longitudinal ties 44, each of which has an end attached to a first 32 of the end plates. The second 34 of these end plates includes four apertures 46 formed in its internal grid 38 for passing each of ties 44 from the other respective, free end. The transverse dimension of longitudinal ties 44 is chosen such that they may be housed in longitudinal recesses 26 with a degree of transverse clearance, the utility of which will appear more clearly in what follows. It should be noted that only a single one of longitudinal ties 44 is fully visible in FIG. 1.

The assembly of storage device 10 will now be described.

Each of four quarter baskets 12 is installed on a corresponding longitudinal tie 44 by passing the latter into longitudinal recess 26 designed for this purpose in quarter basket 12, such that all four quarter baskets 12 come to rest against first end plate 32.

Second end plate 34 is then installed on the free end of each longitudinal tie 44, inserting this free end into corresponding passage aperture 46 of second end plate 34.

Lastly, a control nut 48 is screwed on to the free end of each longitudinal tie 44, so as to cause second end plate 34 to be axially retained relative to first end plate 32.

It thus appears that both end plates 32, 34 form elements for axial retention of quarter baskets 12. Due to the fact that they are housed in longitudinal recesses 26, longitudinal ties 44 also cause a radial retention of quarter baskets 12. End plates 32, 34 and longitudinal ties 44 thus provide the overall cohesion of storage device 10.

FIG. 2 illustrates the contact between second end plate 34 and a quarter basket 12 through bearing surface 42 of end plate 34 and through bearing surface 30 of quarter basket 12.

It should be noted that when a section of bearing surface 42 is seen in any plane passing through longitudinal axis 15 of storage device 10, this bearing surface 42 has the shape of a line segment inclined relative to this axis 15.

As a consequence of the transverse clearance allowed between longitudinal ties 44 and recesses 26 of said ties 44, quarter baskets 12 can be displaced radially relative to longitudinal axis 15 of storage device 10. The abovementioned transverse clearance is preferably sufficiently great to allow contact between quarter baskets 12 and the wall of the cavity of the packaging intended to receive storage device 10.

Such a radial displacement of quarter baskets 12 can be obtained by screwing control nuts 48. Indeed, since respective tapered bearing surfaces 42 of end plates 32 and 34 are pressed against bearing surfaces 30, having the shape of a sector of a truncated cone, of quarter baskets 12, tightening control nuts 48 causes both end plates 32 and 34, which are displaced respectively in the directions represented symbolically by arrows 33 and 35, to come closer to one another, which causes quarter baskets 12 to be displaced radially towards the exterior. Conversely, untightening control nuts 48 allows end plates 32 and 34 to become separated from one another, and therefore causes quarter baskets 12 to be displaced radially towards the interior.

End plates 32 and 34 thus form actuation means allowing quarter baskets 12 to be displaced radially towards the exterior, where these actuation means are, in the first preferred embodiment described here, controlled by control nuts 48.

The assembly formed by actuation means 32, 34, longitudinal ties 44 and control nuts 48, together with bearing surfaces 30 of quarter baskets 12, constitutes deployment means, in the terminology of the invention.

Storage device 10 can be used in the manner described below.

To facilitate the insertion of storage device 10 into the internal cavity of a form of packaging, end plates 32 and 34 are initially separated from one another, such that quarter baskets 12 are able to occupy a position close to longitudinal axis 15 of storage device 10, so as to reduce the transverse encumbrance of this device.

When storage device 10 is housed in the internal cavity of the abovementioned packaging, the control nuts are tightened until respective outer walls 16, having the shape of a quarter cylinder, of quarter baskets 12 come to rest against the wall of the cavity of the packaging, which enables the heat exchanges between storage device 10 and the packaging to be optimised, as explained above.

The functional diagram of FIG. 3 illustrates storage device 10 when the latter is housed in the internal cavity of the abovementioned packaging, designated here by reference 50, and of which only the side wall is represented here. In this figure, end plates 32, 34 of the device are in their position of close proximity, such that the quarter baskets of the device are deployed radially towards the exterior, and pressed against the side wall of the packaging.

This diagram illustrates in particular axial forces 54 exerted by longitudinal ties 44 on end plates 32 and 34, together with resulting forces 56 exerted by the abovementioned plates on quarter baskets 12, which have a radial component due to the configuration of bearing surfaces 42 and 30, and radial forces 58 resulting from the pressing of respective outer walls 16 of quarter baskets 12 on the wall of the cavity of packaging 50.

Generally, when storage device 10 is in its deployed position inside the cavity of packaging 50, nuclear fuel assemblies can be loaded into recesses 14 designed for this purpose, by passing these assemblies through perforations 40 of one or other of end plates 32, 34.

In practice, the packaging habitually includes a cover at one of its longitudinal ends, and a base at the other of its longitudinal ends, on which base the storage device rests, where the container formed in this manner is placed on this end, in a vertical position, during operations to load or unload nuclear fuel, and in a horizontal position during transport of it. The fuel assemblies can thus be loaded in the container through the end plate which is located at the end opposite the base of the packaging, and which is for this reason commonly called the head plate, where the other of the end plates is sometimes called the base plate.

Figure 4:
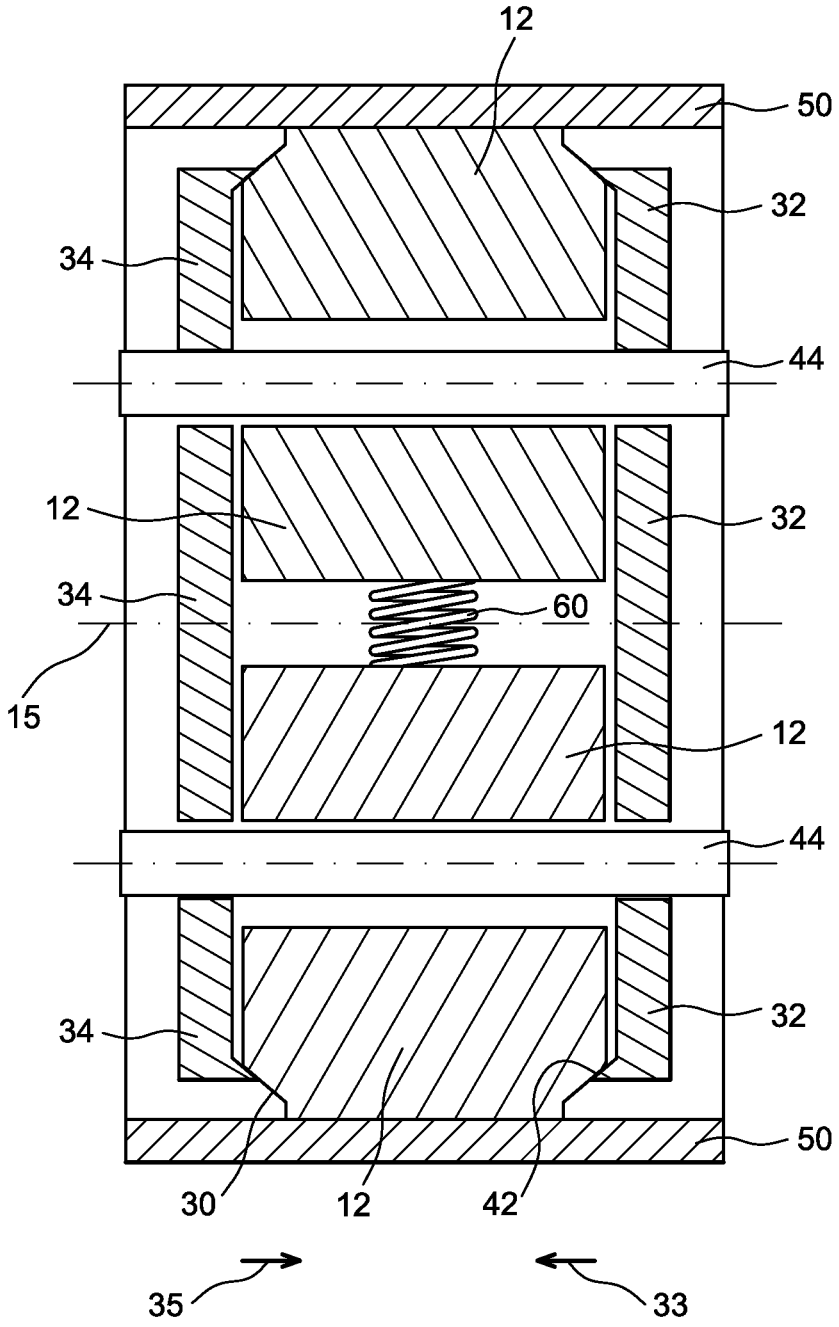
FIG. 4 is a schematic view as an axial section of a storage device according to a second embodiment of the invention, in a deployed position.
Figure 5:
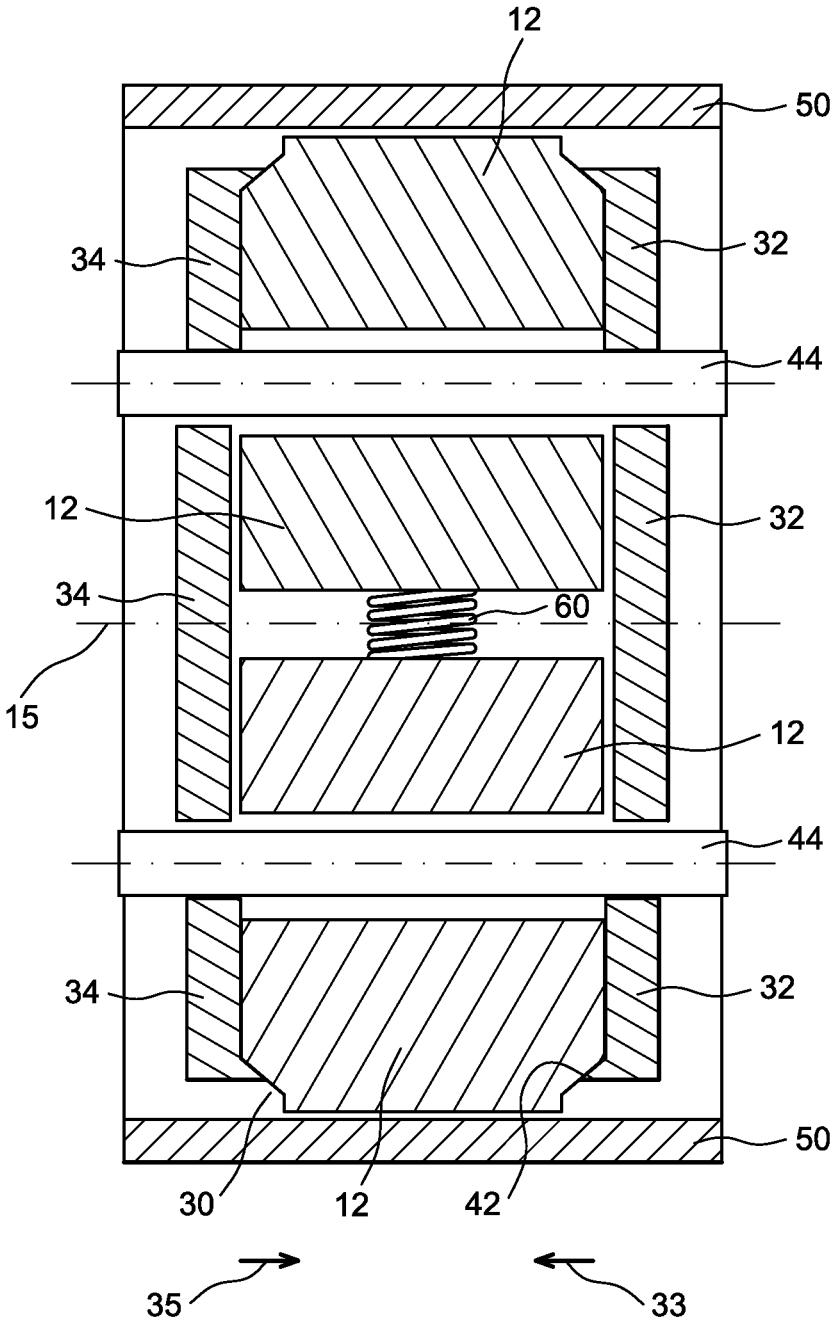
FIG. 5 is a diagrammatic view as an axial section of the storage device of FIG. 4, in a retracted position.

In a second preferred embodiment of the invention illustrated by FIGS. 4 and 5, the alignment of the respective bearing surfaces of end plates 32, 34 and of quarter baskets 12 is reversed relative to the alignment in the first embodiment described above. Bearing surface 30 of each quarter basket is thus oriented radially towards the exterior, whereas bearing surface 42 of each end plate 32, 34 is oriented radially towards the interior.

Consequently, end plates 32, 34 oppose the quarter baskets' 12 radial displacement towards the exterior. In addition, a displacement of end plates 32 and 34 respectively in directions 33 and 35 causes quarter baskets 12 to be displaced radially towards the interior, whereas a displacement of end plates 32 and 34 in directions respectively opposite directions 33 and 35 allows quarter baskets 12 to be displaced radially towards the exterior.

In this second embodiment, in order to cause quarter baskets 12 to be displaced radially towards the exterior, jointly with a displacement of end plates 32 and 34 respectively in the directions opposite directions 33 and 35, elastic means 60 are provided, centred on axis 15 of the storage device, and interposed between quarter baskets 12 so as to pull these quarter baskets 12 radially towards the exterior. These elastic means are, for example, formed by one or more compression springs 60.

FIG. 4 illustrates the storage device in a deployed position, in which end plates 32 and 34 are sufficiently far apart to allow the quarter baskets to come into contact with wall 50 of the packaging under the effect of the pressure of elastic means 60.

Conversely, FIG. 5 illustrates the storage device in a refracted position.

The storage device according to this second embodiment has the advantage that it guarantees that the quarter baskets will be retracted radially towards the interior when the end plates are displaced relative to one another for this purpose, but has the disadvantage that it is of more complex design than the device of the first embodiment described above.

Generally, in both embodiments described above, bearing surface 42 of end plates 32 and 34 is a surface of revolution extending all the way around axis 15 of the device, but this surface 42 can, as a variant, be replaced by multiple separate surfaces distributed around this axis 15, which can take the form of sectors of a truncated cone, or be flat surfaces, and are preferably of a shape conjugate with the shape of bearing surfaces 30 of quarter baskets 12.

In addition, although it is preferable for the contact between end plates 32, 34 and quarter baskets 12 to be of a "surface on surface" type, as in both embodiments described above, to facilitate the sliding of the bearing surfaces on one another, it is yet possible for this contact to be made through the support of a relatively large surface, which may be of revolution or divided into sectors, as described above, on one or more quasi-punctiform surfaces, i.e. surfaces of relatively small size, which are formed, for example, at the end of lengthened elements such as rods or teeth. In this case, the surface of relatively small size can, as desired, be formed on end plates 32, 34, in which case the lengthened elements are supported by quarter baskets 12, or formed on quarter baskets 12, in which case the lengthened elements are supported by end plates 32, 34.

It should also be noted that in FIGS. 3 and 4 the contact between respective outer walls 16 of quarter baskets 12 and the wall of the cavity of packaging 50 is a continuous contact along the entire circumference, and over the full length of quarter baskets 12. Naturally, it is possible, as a variant, depending on the manufacturing tolerances and the surface condition of the parts of storage device 10 and of packaging 50, for this contact to be made only on a portion of the circumference, and of the longitudinal extent of quarter baskets 12. In this case, displacing quarter baskets 12 radially towards the exterior nonetheless causes these quarter baskets to come closer to the wall of packaging 50, and therefore causes an improvement of the heat exchanges between storage device 10 and packaging 50.

In addition, storage device 10 can, within the scope of the invention, include only a single end plate 32, in which case each of longitudinal ties 44 has a first end attached to the base of packaging 50, and a second opposite end intended for the installation of single end plate 32 and of control nuts 48 or similar.

In the embodiments described above each quarter basket 12 fully delimits several recesses 14 for the fuel assemblies. It is however also possible that some or all of the recesses of the device are each delimited jointly by several adjacent quarter baskets, without going beyond the scope of the invention.

In addition, storage device 10 can include a number of substructures 12 which is other than four, in which case the shape of these substructures is then modified accordingly.

Finally, if it is preferable that all substructures 12 of storage device 10 should be able to be displaced radially, it is possible, without going beyond the scope of the present invention, for only some of these substructures to have this property.

The invention claimed is:

1. A removable storage device intended to be housed in an internal cavity of a form of packaging for transporting and/or storing radioactive materials, including several substructures which can be displaced relative to one another and positioned around a longitudinal axis of the device, where all these substructures entirely define multiple adjacent recesses intended to contain said radioactive materials, and where each substructure delimits at least partly at least one of said recesses, where the device includes deployment means for deploying said substructures, where these deployment means include actuation means distinct from said substructures and acting by collaboration of shapes on a longitudinal end of each of said substructures of the device through at least one bearing surface having, when seen in section along any plane passing through said longitudinal axis, the shape of a line segment inclined relative to said axis, such that displacing said actuation means in a first direction parallel to said longitudinal axis causes said substructures to be displaced radially towards the exterior relative to said longitudinal axis.

2. A device according to claim 1, wherein said actuation means cooperate with said longitudinal end of said substructures of the device such that a displacement of said actuation means in a second direction opposite said first direction causes said substructures to be displaced radially towards the interior.

3. A device according to claim 1, wherein said deployment means include elastic means which urge said substructures radially towards the exterior, and wherein said actuation means oppose said substructures' radial displacement towards the exterior.

4. A device according to claim 1, wherein said bearing surface has a flat or tapered shape, or the shape of a sector of a truncated cone.

5. A device according to claim 1, wherein said bearing surface is formed on or positioned opposite a longitudinal end of said substructures.

6. A device according to claim 5, wherein said actuation means include a first element for axial retention of the substructures of the device, on which said bearing surface is formed.

7. A device according to claim 6, wherein said first element for axial retention is formed from a first end plate which includes perforations for the passage of said radioactive materials, and on the periphery of which said bearing surface is formed.

8. A device according to claim 6, wherein said actuation means include a second element for axial retention of the substructures of the device, connected to said first element for axial retention by at least one longitudinal tie and positioned such that the substructures of the device are interposed between said first and second elements for axial retention.

9. A container for transporting and/or storing radioactive materials, including a form of packaging delimiting an internal cavity, together with a removable storage device according to claim 1 housed in said internal cavity.

* * * * *